US006008183A

United States Patent [19]

Morioka et al.

[11] Patent Number: 6,008,183

[45] Date of Patent: Dec. 28, 1999

[54] DETERGENT COMPOSITION

[75] Inventors: Tomoki Morioka; Takashi Sekiguchi; Toshio Nozaki, all of Tokyo, Japan

[73] Assignee: Kao Corporation, Tokyo, Japan

[21] Appl. No.: 08/953,431

[22] Filed: Oct. 17, 1997

[30] Foreign Application Priority Data

Oct. 21, 1996 [JP] Japan ..... 8-297071

[51] Int. Cl.[6] ..... C11D 1/825

[52] U.S. Cl. ..... 510/506; 510/466

[58] Field of Search ..... 510/122, 123, 510/130, 466, 505, 506

[56] References Cited

U.S. PATENT DOCUMENTS

| | | | |
|---|---|---|---|
| 4,098,713 | 7/1978 | Jones | 252/89 |
| 4,411,933 | 10/1983 | Samejima et al. | 427/213.3 |
| 4,883,659 | 11/1989 | Goodman et al. | 424/78 |
| 5,039,516 | 8/1991 | Goodman et al. | 424/59 |
| 5,275,755 | 1/1994 | Sebag et al. . | |
| 5,324,507 | 6/1994 | Dubief et al. . | |
| 5,496,492 | 3/1996 | Hamada et al. . | |
| 5,567,428 | 10/1996 | Huighes | 424/401 |
| 5,632,998 | 5/1997 | Midha et al. | 424/401 |
| 5,648,323 | 7/1997 | Coffindaffer et al. | 510/122 |
| 5,660,839 | 8/1997 | Allec et al. | 424/401 |
| 5,681,804 | 10/1997 | Hamada et al. . | |

FOREIGN PATENT DOCUMENTS

| | | |
|---|---|---|
| 0306007A2 | 3/1989 | European Pat. Off. . |
| 0340989A2 | 11/1989 | European Pat. Off. . |
| 0354856A3 | 2/1990 | European Pat. Off. . |
| 0457688A1 | 11/1991 | European Pat. Off. . |
| 0498716A1 | 8/1992 | European Pat. Off. . |
| 0531684A1 | 3/1993 | European Pat. Off. . |
| WO9424253 | 10/1994 | WIPO . |

*Primary Examiner*—Yogendra Gupta
*Assistant Examiner*—John R. Hardee
*Attorney, Agent, or Firm*—Birch, Stewart, Kolasch & Birch, LLP

[57] ABSTRACT

The present invention relates to a detergent composition which is primarily used on the skin, and more particularly to a detergent composition which provides comfortable and smooth touch on the skin after cleansing. These compositions comprise:

(A) a glycerol derivative represented by the following formula (1)

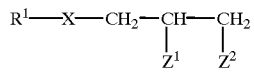

(1)

wherein one of $Z^1$ and $Z^2$ represents $R^2$—Y— and the other of $Z^1$ and $Z^2$ represents —OH and wherein $R^1$ and $R^2$, which may be the same or different, represent hydrocarbon groups having C3–C12 straight or branched chain or hydrocarbon groups having C14–C20 branched chain respectively and X and Y represent an oxygen atom or

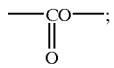

(B) at least one silicone, and (C) at least one surfactant selected from the group consisting of an anionic surfactant, an amphoteric surfactant and a nonionic surfactant, wherein component (A) and component (C) are present in a ratio of from 1:1 to 1:100, by weight.

13 Claims, No Drawings

DETERGENT COMPOSITION

FIELD OF THE INVENTION

The present invention relates to a detergent composition which is primarily used on the skin, and more particularly to a detergent composition which provides a comfortable and smooth touch on the skin after cleansing.

BACKGROUND OF THE INVENTION

Conventional skin detergents are used to wash away dirt or soil caused by such substances as sebum or sweat. A variety of approaches have been developed to add various ingredients in a detergent composition so as to provide smooth and moisturized touch on the skin after cleansing. It has been proposed to use silicones as such ingredients since they can be deposited on the skin after rinsing of the detergent composition to improve smooth touch of the skin. However, it is very difficult to keep a dispersed, incompatible silicone material suspended in the composition and the total product stable.

It is therefore an object of the present invention to provide a stable detergent composition which provides unique, comfortable and smooth touch on the skin after cleansing.

SUMMARY OF THE INVENTION

It has been surprisingly found that a detergent composition comprising a glycerol derivative, a silicone and a surfactant, provides a unique, comfortable and smooth touch on the skin after cleansing and is stable during storage (e.g., there is no separation of the ingredients therein).

The present invention relates to a detergent composition comprising:

(A) a glycerol derivative represented by the following formula (1)

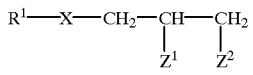

(1)

wherein one of $Z^1$ and $Z^2$ represents $R^2$—Y— and the other of $Z^1$ and $Z^2$ represents —OH and wherein $R^1$ and $R^2$, which may be the same or different, represent hydrocarbon groups having C3–C12 straight or branched chain or hydrocarbon groups having C14–C20 branched chain respectively and X and Y represent an oxygen atom or

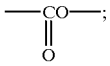

(B) at least one silicone; and (C) at least one surfactant selected from the group consisting of an anionic surfactant, an amphoteric surfactant and a nonionic surfactant, wherein component (A) and component (C) are present in a ratio of from 1:1 to 1:100, by weight.

Various other objects, features, and attendant advantages of the present invention will be more fully understood from the following detailed description.

DESCRIPTION OF THE PREFERRED EMBODIMENTS

Component (A)

An essential component of the present composition is a glycerol derivative represented by the following formula (1)

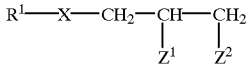

(1)

wherein one of $Z^1$ and $Z^2$ represents $R^2$—Y— and the other of $Z^1$ and $Z^2$ represents —OH and wherein $R^1$ and $R^2$, which may be the same or different, represent hydrocarbon groups having C3–C12 straight or branched chain or hydrocarbon groups having C14–C20 branched chain respectively and X and Y represent an oxygen atom or

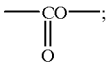

Preferred glycerol derivatives shown by the above formula (1) are those, 1) $R^1$ and $R^2$ of the formula (1) represent C4–C12 hydrocarbon groups respectively, 2) at least one of $R^1$ and $R^2$ of the formula (1) comprises a branched aliphatic chain, or 3) $R^1$ and $R^2$ of the formula (1) represent C10–C20 hydrocarbon groups respectively and at least one of $R^1$ and $R^2$ comprises a branched aliphatic chain. These glycerol derivatives may be used alone or used as mixtures thereof to produce a stable detergent composition which provides very comfortable and smooth touch on the skin after cleansing.

Glycerol derivatives useful herein include 1,3-dialkyl glyceryl ethers represented by the following formula (2)

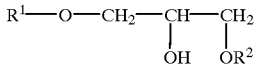

(2)

wherein $R^1$ and $R^2$ are as defined above.

Other glycerol derivatives useful as component (A) are 1,3-diacyl glycerols represented by the following formula (3)

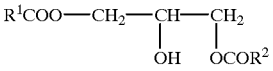

(3)

wherein $R^1$ and $R^2$ are as defined above.

In general, commercially available acyl glycerols are mixtures of mono-glycerol esters and di-glycerol esters, therefore those mixtures can be used as component (A).

The glycerol derivatives of component (A) is present at a level of from about 1 to about 20 weight % (hereinafter referred to as %), preferably from about 0.5 to about 10% in the detergent composition. Above all, incorporation of from about 1 to about 10% of the above described glycerol derivatives 1) in combination with from about 0.5 to about 5% of the above described glycerol derivatives 3) into the detergent composition improves the stability of the composition remarkably.

Component (B)

Component (B) may include a wide variety of silicones, such as dimethyl silicone, cyclic dimethyl silicone, methyl hydrogen silicone, polyether modified silicone, methyl phenyl silicone, and stearoxy modified silicone as well as silicone emulsions of dimethyl silicone and amodimethicones and the like.

Preferred silicones are high molecular weight dimethyl polysiloxanes, e.g. oil type with a viscosity of from 10,000 to 100,000 centipoise and emulsion type gum with a viscosity of from 5,000,000 to 15,000,000 centipoise.

The silicone of component (13) is present at a level of from about 0.5 to about 50%, preferably from about 1 to about 20% in the detergent composition.

Component (C)

Component (C) is at least one surfactant selected from the group consisting of anionic surfactants, amphoteric surfactants and nonionic surfactants.

Anionic surfactants useful herein include alkyl phosphate, alkyl sulfonate, alkyl sulfate, acylated amino acid salt, polyoxyethylene alkyl ether sulfate, alkylbenzene sulfonate, N-acyl-N-methyl taurine salt, α-olefin sulfonate, higher fatty acid ester sulfonate, alkyl ether acetate, polyoxyethylene alkyl ether acetate, fatty acid soap and salts of these compounds. Preferred examples of anionic surfactants are polyoxyethylene lauryl ether sulfate, N-lauroyl-β-alanine salt, monoalkyl phosphate, polyoxyethylene lauryl ether acetate and polyoxyethylene lauryl amide acetate. Suitable salts include metal salts, such as sodium, potassium or magnesium salts, ammonium salts, and organic ammonium salts, such as monoethanol ammonium, diethanol ammonium or triethanol ammonium salts.

Amphoteric surfactants useful herein include carbobetaine, amidobetaine, sulfobetaine, hydroxy sulfobetaine, amidosulfobetaine, phosphobetaine, imidazolium betaine and amine oxide. Preferred examples of amphoteric surfactants are amidopropyl betaine, laurylhydroxysulfobetaine, 2-alkyl-N-carboxymethyl-N-hydroxyethyl imidazoliumbetaine and lauryldimethylamine oxide.

Nonionic surfactants useful herein include polyoxyethylene fatty acid ester, polyoxyethylene hardened castor oil, polyoxyethylene sorbitan fatty acid ester, glycerol fatty acid ester, polyoxyethylene alkyl ether and polyoxyethylene polyoxypropylene glycol. Preferred examples of nonionic surfactants are polyethyleneglycol monostearate, polyoxyethylene lauryl ether and polyoxyethylene (160) polyoxypropylene (30) glycol.

The content of the component (C), which may vary depending on the types and properties of the aimed detergent composition, is from about 2 to about 60%, preferably from about 10 to about 50% in the detergent composition. Above all, incorporation of at least about 5%, preferably at least about 12% of an anionic surfactant as component (C) into the detergent composition highly improves the stability of the composition. The surfactant of component (C) may be used alone, or preferably used as mixtures of anionic, amphoteric and nonionic surfactants.

In the detergent composition of the present invention, the component (A) and the component (C) are present in a ratio of from 1:1 to 1:100, preferably from 1:2 to 1:50, more preferably from 1:3 to 1:20, by weight.

Further, a variety of conventional detergent ingredients can be incorporated into the detergent composition of the present invention in addition to the above described essential components, to the extent the particular ingredient does not adversely effect the function and properties of the detergent composition. These conventional ingredients may include viscosity regulators, such as anionic polymers, nonionic polymers or cationic polymers; moisturizers such as polyalcohols; foaming agent such as amides or fatty acids; preservatives; antioxidants; perfumes; and pigments.

The detergent compositions of the present invention are useful for cleansing the skin. Typically, a suitable amount of the composition is directly applied to the skin, which has optionally been premoistened with water. Alternatively, a suitable amount of the composition can be applied to the skin via intermediate application to the hands, a washcloth, a sponge, or other application device. It has been found that the detergent compositions of the present invention provide their optimal cleansing performance when combined with water during the cleansing process. To complete the cleansing process, the detergent compositions of the present invention are thoroughly rinsed from the skin with water.

The detergent composition of the present invention can be prepared in accordance with conventional methods. While the formulations and the properties, such as viscosity or pH value, are not restricted in particular, it is preferable to formulate the composition in a form of liquid or cream. The pH value is usually adjusted from 5 to 12, preferably from 6 to 8, and the viscosity is adjusted at least 500 centipoise, preferably at least 3,000 centipoise.

EXAMPLES

The following examples further describe and demonstrate the preferred embodiments within the scope of the present invention. The examples are given solely for the purpose of illustration, and are not to be construed as limitations of the present invention, since many variations thereof are possible without departing from its spirit and scope.

The contents of the ingredients are shown by weight % in the compositions.

Example 1

A liquid body detergent composition was prepared by mixing the following ingredients.

| Ingredients | Weight percent |
|---|---|
| Sodium polyoxyethylene (3) lauryl ether sulfate(27%) | 60 |
| Lauric acid amidopropyl betaine | 4 |
| Lauric acid diethanol amide | 3 |
| High molecular weight methyl polysiloxane emulsion (*1) | 10 |
| Caprylic acid mono/di glyceride (*2) | 4 |
| Monoisostearic acid monomyristic acid diglyceride | 1 |
| Dibutyl hydroxy toluene | 0.1 |
| Perfume | 0.5 |
| Purified water | balance |

(*1): "BY22-020" offered by Toray Dow Corning Silicone Co.
(*2): "Sunsoft 707" offered by Taiyo Chemical Co.

The composition was excellent in creating foam, was excellent in the quality of the foam, and provided a comfortable and smooth touch on the skin after cleansing and drying with towel. While the composition was stable after storage for 20 days at 50° C., it was difficult to disperse the silicone in a composition with the same ingredients without glycerol derivatives to obtain a stable composition.

Example 2

A liquid body detergent composition was prepared by mixing the following ingredients. The composition was excellent in creating foam, was excellent in the quality of the foam, and provided a comfortable and smooth touch on the skin after cleansing and drying with towel. While the composition was stable after storage for 20 days at 50° C., it was difficult to disperse the silicone in a composition with the same ingredients without glycerol derivatives to obtain a stable composition.

| Ingredients | Weight percent |
|---|---|
| Sodium polyoxyethylene(3)lauryl ether sulfate(27%) | 60 |
| Lauric acid amidopropyl betaine | 4 |
| Lauric acid diethanol amide | 3 |
| Lauric acid | 1 |
| Octamethyl trisiloxane | 5 |
| Cationated cellulose (*3) | 0.1 |
| Caprylic acid mono/di glyceride (*2) | 4 |
| Monoisostearic acid monomyristic acid diglyceride | 1 |
| Polyoxyethylene (160) polyoxypropylene (30) glycol | 0.5 |
| Dibutyl hydroxy toluene | 0.1 |
| Perfume | 0.5 |
| Purified water | balance |

(*3): "Polymer JR-400" offered by Union Carbide Co.

Example 3

A liquid body detergent composition was prepared by mixing the following ingredients.

| Ingredients | Weight percent |
|---|---|
| Sodium polyoxyethylene(3)lauryl ether sulfate(27%) | 50 |
| Lauryl dimethyl amine oxide | 3 |
| Coconut oil fatty acid diethanol amide | 3 |
| Myristic acid | 1 |
| Decamethyl cyclopenta siloxane | 3 |
| Hydroxyethyl cellulose (*4) | 0.2 |
| Caprylic acid mono/di glyceride (*2) | 4 |
| Monoisostearic acid monomyristic acid diglyceride | 1 |
| Polyoxyethylene (5) lauryl ether | 0.5 |
| Dibutyl hydroxy toluene | 0.1 |
| Perfume | 0.5 |
| Purified water | balance |

(*4): "HEC Daicel SE-850K" offered by Daicel Co.

The composition was excellent in creating foam, was excellent in the quality of the foam, and provided a comfortable and smooth touch on the skin after cleansing and drying with towel. While the composition was stable after storage for 20 days at 50° C., it was difficult to disperse the silicone in a composition with the same ingredients without glycerol derivatives to obtain a stable composition.

Example 4

A liquid body detergent composition was prepared by mixing the following ingredients. The composition was excellent in creating foam, was excellent in the quality of the foam, and provided a comfortable and smooth touch on the skin after cleansing and drying with towel. While the composition was stable after storage for 20 days at 50° C., it was difficult to disperse the silicone in a composition with the same ingredients without glycerol derivatives to obtain a stable composition.

| Ingredients | Weight percent |
|---|---|
| Sodium polyoxyethylene(3)lauryl ether sulfate(27%) | 60 |
| 2-alkyl-N-carboxymethyl-N-hydroxyethyl imidazoliumbetaine | 2 |
| Lauric acid monoethanol amide | 2 |
| Lauric acid | 2 |
| Methyl hydrogen polysiloxane | 3 |
| Caprylic acid mono/di glyceride (*2) | 4 |

-continued

| Ingredients | Weight percent |
|---|---|
| Monoisostearic acid monomyristic acid diglyceride | 1 |
| Dibutyl hydroxy toluene | 0.1 |
| Perfume | 0.5 |
| Purified water | balance |

Example 5

A liquid body detergent composition was prepared by mixing the following ingredients.

| Ingredients | Weight percent |
|---|---|
| Sodium polyoxyethylene(3)lauryl ether sulfate(27%) | 50 |
| Lauryl hydroxy sulfobetaine | 3 |
| Lauric acid isopropanol amide | 2 |
| Lauric acid | 1 |
| Polyoxyethylene-methylpolysiloxane copolymer (*5) | 4 |
| Caprylic acid mono/di glyceride (*2) | 4 |
| Monoisostearic acid monomyristic acid diglyceride | 1 |
| Polyoxyethylene(20) sorbitan monolaurate | 0.5 |
| Dibutyl hydroxy toluene | 0.1 |
| Perfume | 0.5 |
| Purified water | balance |

(*5): "KF353A" offered by Shinetsu Silicone Co.

The composition was excellent in creating foam, was excellent in the quality of the foam, and provided a comfortable and smooth touch on the skin after cleansing and drying with towel. While the composition was stable after storage for 20 days at 50° C., it was difficult to disperse the silicone in a composition with the same ingredients without glycerol derivatives to obtain a stable composition.

Example 6

A liquid body detergent composition was prepared by mixing the following ingredients. The composition was excellent in creating foam, was excellent in the quality of the foam, and provided a comfortable and smooth touch on the skin after cleansing and drying with towel. While the composition was stable after storage for 20 days at 50° C., it was difficult to disperse the silicone in a composition with the same ingredients without glycerol derivatives to obtain a stable composition.

| Ingredients | Weight percent |
|---|---|
| Sodium polyoxyethylene(3)lauryl ether sulfate(27%) | 50 |
| Lauric acid amidopropyl betaine | 3 |
| Lauric acid diethanol amide | 3 |
| Lauric acid | 1 |
| High molecular weight methyl polysiloxane emulsion (*1) | 4 |
| Caprylic acid mono/di glyceride (*2) | 4 |
| Monoisostearic acid monomyristic acid diglyceride | 1 |
| Dibutyl hydroxy toluene | 0.1 |
| Perfume | 0.5 |
| Purified water | balance |

Example 7

A liquid body detergent composition was prepared by mixing the following ingredients.

| Ingredients | Weight percent |
|---|---|
| Sodium polyoxyethylene lauric acid monoethanol amide acetate | 10 |
| Lauryl hydroxy sulfobetaine | 2 |
| Lauric acid | 5 |
| Myristic acid | 5 |
| High molecular weight methyl polysiloxane emulsion (*1) | 5 |
| Caprylic acid mono/di glyceride (*2) | 4 |
| Perfume | 0.5 |
| Purified water | balance |

The composition was excellent in creating foam, was excellent in the quality of the foam, and provided a comfortable and smooth touch on the skin after cleansing and drying with towel. While the composition was stable after storage for 20 days at 50 0C, it was difficult to disperse the silicone in a composition with the same ingredients without glycerol derivatives to obtain a stable composition.

Example 8

A liquid body detergent composition was prepared by mixing the following ingredients. The composition was excellent in creating foam, was excellent in the quality of the foam, and provided a comfortable and smooth touch on the skin after cleansing and drying with towel. While the composition was stable after storage for 20 days at 50 0C, it was difficult to disperse the silicone in a composition with the same ingredients without glycerol derivatives to obtain a stable composition.

| Ingredients | Weight percent |
|---|---|
| Sodium polyoxyethylene lauric acid monoethanol amide acetate | 10 |
| Lauryl hydroxy sulfobetaine | 2 |
| Lauric acid | 5 |
| Myristic acid | 5 |
| High molecular weight methyl polysiloxane emulsion (*1) | 5 |
| Caprylic acid mono/di glyceride (*2) | 5 |
| Dibutyl hydroxy toluene | 0.1 |

-continued

| Ingredients | Weight percent |
|---|---|
| Perfume | 0.5 |
| Purified Water | balance |

Example 9

A liquid body detergent composition was prepared by mixing the following ingredients.

| Ingredients | Weight percent |
|---|---|
| Potassium alkylphosphate | 15 |
| Lauryl hydroxy sulfobetaine | 2 |
| Lauric acid amidopropylbetaine | 4 |
| Lauric acid isopropanol amide | 3 |
| High molecular weight methyl polysiloxane emulsion (*1) | 5 |
| Caprylic acid mono/di glyceride (*2) | 5 |
| Monoisostearic acid monomyristic acid diglyceride | 1 |
| Dibutyl hydroxy toluene | 0.1 |
| Perfume | 1 |
| Purified water | balance |

The composition was excellent in creating foam, was excellent in the quality of the foam, and provided a comfortable and smooth touch on the skin after cleansing and drying with towel. While the composition was stable after storage for 20 days at 50 C, it was difficult to disperse the silicone in a composition with the same ingredients without glycerol derivatives to obtain a stable composition.

Examples 10–12 and Comparative Examples 1–3

The under-mentioned liquid detergent compositions were prepared by mixing the ingredients listed in the table. (In the table, bal. means balance.)

The stabilization effect given by caprylic acid mono/di glyceride (glycerol derivative) to the compositions were evaluated in the following manner.

80 ml of the detergent compositions were stored in 100 ml glass bottles respectively for 20 days at 50° C. The stability of each composition was evaluated by observing the appearance and designated as follows.

○: Practically no separation occurred

Δ: Slight separation occurred x: Separation occurred

| Ingredients | Examples 10 | 11 | 12 | Comparative Examples 1 | 2 | 3 |
|---|---|---|---|---|---|---|
| Sodium polyoxyethylene(3)lauryl-ether sulfate(27%) | 16 | 16 | 16 | 16 | 16 | 16 |
| Lauric acid amidopropyl betaine | 4 | 4 | 4 | 4 | 4 | 4 |
| Caprylic acid mono/di glyceride(*2) | 4 | 4 | 4 | — | — | — |
| Lauric acid diethanol amide | 3 | 3 | 3 | 3 | 3 | 3 |
| Polyoxyethylene (160) polyoxy-propylene (30) glycol | 0.5 | 0.5 | 0.5 | 0.5 | 0.5 | 0.5 |
| Polyoxyethylene (5) lauryl ether | 0.5 | 0.5 | 0.5 | 0.5 | 0.5 | 0.5 |
| High molecular weight methyl polysiloxane emulsion (*1) | 5 | — | — | 5 | — | — |
| Polyoxyethylene-methylpoly-siloxane copolymer (*5) | — | 3 | — | — | 3 | — |
| Methyl polysiloxane (200 cs) | — | — | 3 | — | — | 3 |
| Purified water | bal. | bal. | bal. | bal. | bal. | bal. |
| Stabiliy 50° C., 20 days | ○ | ○ | ○ | Δ | X | X |

According to the present invention, water insoluble silicones can be dispersed into a detergent composition stably by adding glycerol derivatives of the formula (1). The detergent composition of the present invention provides unique, comfortable and smooth touch on the skin after cleansing. The entire disclosure of Japanese Patent Application No. 8-297071 filed on Oct. 21, 1996 including specification, claims drawings and summary is incorporated herein by reference in its entirety.

What is claimed is:

1. A detergent composition comprising:

(A) a glycerol derivative represented by the following formula (1)

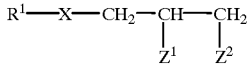

(1)

wherein one of $Z^1$ and $Z^2$ represents $R^2$—Y—, and the other of $Z^1$ and $Z^2$ represents —OH, and wherein $R^1$ and $R^2$, which may be the same or different, represent hydrocarbon groups having $C_3$–$C_9$ straight or branched chain and X and Y represent an oxygen atom;

(B) at least one silicone; and (C) at least one surfactant selected from the group consisting of an anionic surfactant; and amphoteric surfactant and a nonionic surfactant, wherein component (A) and component (C) ate present in a ratio of from 1:1 to 1:100, by weight.

2. The detergent composition of claim 1, wherein component (A) is 1,3-dialkyl glyceryl ether represented by the following formula (2)

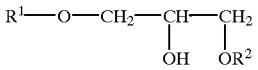

(2)

wherein $R^1$ and $R^2$ are as defined above.

3. The detergent composition of claim 1, which has a pH value of about 5 to about 12 and a viscosity of at least 500 centipoise.

4. The detergent composition of claim 1, wherein at least one of $R^1$ and $R^2$ of the formula (1) comprises a branched aliphatic chain.

5. The detergent composition of claim 1, wherein the content of component (A) is from about 0.1 to about 20% by weight, based on the total amount of detergent composition.

6. The detergent composition of claim 1, wherein component (B) is selected from the group consisting of dimethyl silicone, cyclic dimethyl silicone, methyl hydrogen silicone, polyether modified silicone, methyl phenyl silicone and stearoxy modified silicone.

7. The detergent composition of claim 1, wherein the content of component (B) is from about 0.5 to about 50% by weight, based on the total amount of detergent composition.

8. The detergent composition of claim 1, wherein component (C) is an anionic surfactant selected from the group consisting of alkyl phosphate, alkyl sulfonate, alkyl sulfate, acylated amino acid salt, polyoxyethylene alkyl ether sulfate, alkylbenzene sulfonate, N-acyl-N-methyl taurine salt, α-olefin sulfonate, higher fatty acid ester sulfonate, alkyl ether acetate, polyoxyethylene alkyl ether acetate, fatty acid soap and salts of these compounds.

9. The detergent composition of claim 1, wherein component (C) is an amphoteric surfactant selected from the group consisting of carbobetaine, amidobetaine, sulfobetaine, hydroxysulfobetaine, amidosulfobetaine, phosphobetaine, imidazolium-betaine and amine oxide.

10. The detergent composition of claim 1, wherein component (C) is a nonionic surfactant selected from the group consisting of polyoxyethylene fatty acid ester, polyoxyethylene hardened castor oil, polyoxyethylene sorbitan fatty acid ester, glycerol fatty acid ester, polyoxyethylene alkyl ether and polyoxyethylene polyoxy-propylene glycol.

11. The detergent composition of claim 1, wherein the content of component (C) is from about 2 to about 60% by weight, based on the total amount of detergent composition.

12. The detergent composition of claim 1, which comprises at least about 5%, preferably at least about 12% by weight of an anionic surfactant as component (C), based on the total amount of detergent composition.

13. A method for cleansing skin comprising applying to the skin the detergent composition of claim 1.

* * * * *